United States Patent [19]

Labelle

[11] Patent Number: 4,748,783

[45] Date of Patent: Jun. 7, 1988

[54] HINGED CLOSURE PANEL WITH INTEGRAL HINGE MEMBER

[75] Inventor: H. M. Robert Labelle, Cornwall, Canada

[73] Assignee: Martinray Industries, Ltd., Ontario, Canada

[21] Appl. No.: 8,470

[22] Filed: Jan. 29, 1987

Related U.S. Application Data

[63] Continuation-in-part of Ser. No. 573,671, Jan. 25, 1984.

[30] Foreign Application Priority Data

May 2, 1983 [CA] Canada ..... 427214

[51] Int. Cl.[4] ..... E04C 2/34; E04C 1/30

[52] U.S. Cl. ..... 52/595; 52/71; 52/309.11; 52/578; 52/593; 52/802; 52/804; 160/218; 160/229.1

[58] Field of Search ..... 52/71, 586, 588, 802, 52/804, 309.11, 579, 580, 593, 595, 578; 160/229 R, 218, 187

[56] References Cited

U.S. PATENT DOCUMENTS

| | | | |
|---|---|---|---|
| 3,182,769 | 5/1965 | Ridder | 52/579 |
| 3,760,548 | 9/1973 | Sauer et al. | 52/588 |
| 4,183,393 | 1/1980 | Bailey | 52/309.11 |

FOREIGN PATENT DOCUMENTS

| | | | |
|---|---|---|---|
| 576448 | 3/1958 | Italy | 52/586 |
| 11377 | of 1886 | United Kingdom | 52/588 |
| 1013091 | 12/1965 | United Kingdom | 52/588 |

*Primary Examiner*—Carl D. Friedman
*Assistant Examiner*—Michael Safavi
*Attorney, Agent, or Firm*—Charles E. Brown; Charles A. Brown

[57] ABSTRACT

An insulated panel for rolling closures. The panel has a front wall and a back wall joined by side walls, and is filled with insulation. The side walls have thermal breaks formed by spacers. The size of the spacers can vary to vary the thickness of the panel. The panel has a hinge socket formed in the back wall adjacent one side wall. An extension of the back wall, projecting past the other side wall, carries a hinge pintle.

5 Claims, 2 Drawing Sheets

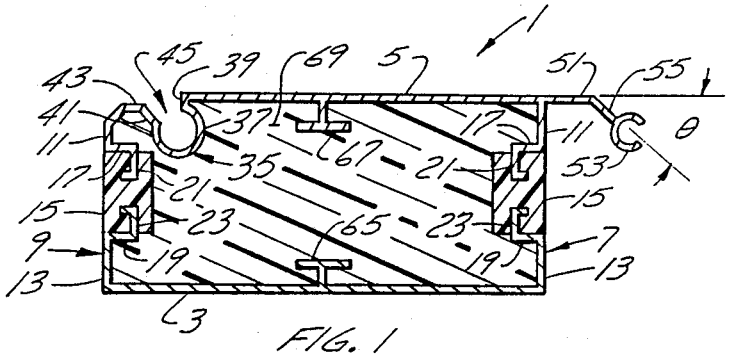
FIG. 1
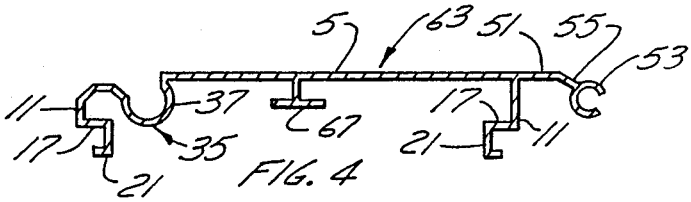
FIG. 4
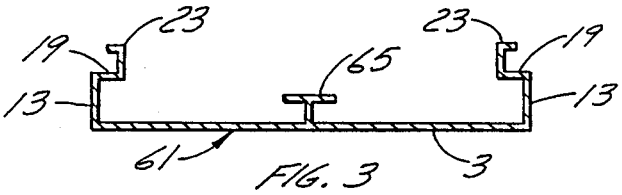
FIG. 3
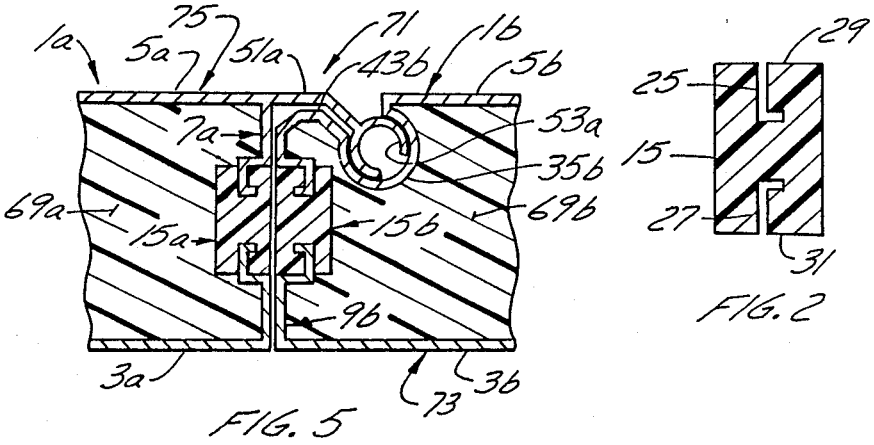
FIG. 2
FIG. 5

HINGED CLOSURE PANEL WITH INTEGRAL HINGE MEMBER

CROSS-REFERENCE TO RELATED APPLICATIONS

This application is a Continuation-in-Part of U.S. application Ser. No. 573,671 filed Jan. 25, 1984.

BACKGROUND OF THE INVENTION

1. Field of the Invention

This invention is directed toward improved closure panels, and to closures incorporating the improved panels.

The invention is more particularly directed toward improved insulated closure panels, and to rolling closures incorporating the improved, insulated closure panels.

The invention is also directed toward a method for making the improved, insulated closure panels.

2. Description of the Prior Art

Closures, particularly of the roll-up type which are made up of a series of panels with adjacent panels pivotally connected together along adjacent sides, are known. It is also known to provide insulation in each panel so as to provide an insulated closure.

The known closures have several disadvantages however. The means for pivotally connecting adjacent panels together are usually located in the adjacent side edges of the panels. However, little insulation can be provided in the panels at or adjacent the side edges when the pivot connections are in the side edges and thus the insulating efficiency of the closure is reduced. If the pivot connections are provided between the adjacent panels, rather than in their side edges, the insulating efficiency of the closure is agian reduced because there is no insulation in the pivot connections.

The known closures are also expensive to manufacture in different thicknesses. Usually the panels in the closure are each made from two wall sections, joined together at their side edges. For each closure of different thickness desired, two additional sizes of wall sections are required to construct the panels used in the closure. The number of different sizes of wall sections that are required to construct closures of different thicknesses makes the closures expensive.

The known closures often do not present a neat apperance. Gaps between adjacent panels are often present and detract from the appearance of the closure. The gaps also reduce the insulating efficiency of the closure and are a source of drafts through the closure.

Another disadvantage of known closures is that with a single pivot connection between adjacent panels, the known closures take up a considerable amount of space when wound up for storage. This is due to the fact that the panels cannot easily follow a spiral path when there is a substantial distance between adjacent pivot connections.

A still further disadvantage in known closures is that the panels, including the pivot connections, are often made from sheet material. The sheet material is bent to provide the desired panel shape and to provide the pivot connections. These panels, and the associated pivot connections, are often not as strong as desired and bend and jam if the closures are accidently hit.

SUMMARY OF THE INVENTION

It is one purpose of the present invention to provide a closure panel which has improved insulating qualities. It is another purpose of the present invention to provide a closure having improved insulating qualities. It is a further purpose of the present invention to provide means by which varying thicknesses of closure panels, and thus varying thicknesses of closures, can be easily and inexpensively made. It is another purpose of the present invention to provide a closure which has a clean, neat appearance. It is yet a further purpose of the present invention to provide a closure panel, and a closure incorporating the panel, which is strong and durable. It is still another purpose of the present invention to provide a closure which requires less space when stored in a wound-up position.

In accordance with one embodiment of the present invention there is provided a closure panel having a substantially rectangular cross-section, with a back wall, a parallel front wall, and side walls connecting the front and back walls. At least one hinge socket is provided in the back wall of the panel adjacent one side wall of the panel. An extension of the back wall at the other side wall of the panel carries a pintle which rotatably fits into the hinge socket on an adjacent panel. In another embodiment of the present invention, a hinge socket is provided in the back wall of the panel adjacent each side wall. A separate hinge member is provided, carrying a pintle on each side. The hinge member pivotally joins two adjacent panels by having one of its pintles rotatably mounted in the hinge socket nearest the side wall of one panel. This side wall is adjacent one side wall of the other panel. The other pintle is rotatably mounted in the hinge socket adjacent the one side wall of the other panel.

With the hinge socket, or sockets, located in the back walls of the panels, rather than in the side walls of the panels, or between the panels, more uniform insulation properties are provided in the closure constructed from such panels. In addition, the location of the pivot connections in the back walls of the panels, allows their adjacent side walls to abut, or to substantially abut, thus providing a neater appearance for the closure and improving its insulation properties. The extension of the back wall, or the separate hinge member, effectively closes any gap between adjacent panels and thus provides a closure with a neat appearance while also minimizing drafts through the closure.

The panels, in either embodiment, are made by extruding two different members, and cutting lengths off the members, equal to the desired width of the closure, to form two panel sections. The members are extruded from a light-weight metallic material such as aluminum. One panel section comprises the front wall and two short outer side wall sections of the panel. The other panel section comprises the back wall and two short inner side wall sections of the panel. The back wall in the other panel section includes the one hinge socket and the pintle extension in the one embodiment, or the two hinge sockets in the other embodiment. The panel is formed by connecting the two extruded lengths of panel sections together, at their short side wall sections, with a pair of spacers. The spacers are made by extruding members from a poor heat conducting material, such as a thermoplastic, and cutting lengths equal to the lengths of the panel sections. The spacers provide a thermal break between the front and back walls of the panel at the sides of the panel. The spacers can be made in various thicknesses so that panels of different thickness can be assembled using the same two extruded panel sections. Thus if a thin panel is required, two thin spacers are used to join the lengths of the two panel sections together at their side wall sections. If a thick panel is required, the same two lengths of panel sections are joined together by two thick spacers. Thus it is seen that only one size of both extruded panel sections is required to form panels of different thickness. While spacers of different thickness are required, their cost is much less than the cost of panel sections of different size, since the small spacers are usually extruded from a thermoplastic material and the larger sections are made from more expensive metallic material.

When a panel has been assembled from the two extruded panel sections and the two spacers of desired size, it is filled with an expandable, insulating, foam material to provide a strong, insulated panel. A series of such panels are then pivotally connected together, either by sliding the pintle of each panel into the socket of an adjacent panel, or by joining each pair of adjacent panels together by sliding the pintles of a hinge member into their adjacent hinge sockets, to form an insulated, rolling closure.

The closure, employing the separate hinge member, and panels with two hinge sockets in each panel, can be wound up tighter than the closure employing panels with a single hinge socket and a pintle on each panel. The use of the separage hinge member, requiring two adjacent hinge sockets, reduces the distance between adjacent pivot points on the closure and this permits it to be wound closer on a storage drum.

The invention is particularly directed toward a panel for a rolling closure comprising a front wall, a back wall generally parallel to the front wall, and first and second side walls joining the front and back walls together. At least one hinge socket is formed in the back wall, the hinge socket extending across the back wall, and located adjacent and parallel to, one of the side walls.

In one embodiment of the invention, a second hinge socket is formed in the back wall, extending across the back wall, and located adjacent and parallel to, the other side wall.

In another embodiment of the invention, an extension is provided of the back wall extending past the other side wall, and a pintle member is provided on the end of the extension of the back wall, extending parallel to the other side wall, and sized to fit snugly into a hinge socket identical to the hinge socket formed in the back wall.

The invention is also directed toward a panel for a rolling closure having a first extruded section with a front wall, and outer side wall sections at the ends of the front wall, and a second extruded section having a back wall and inner side wall sections at the ends of the back wall. A first spacer joins one of the outer side wall sections to one of the inner side wall sections and a second spacer joins the other, outer, side wall section to the other, inner, side wall section.

The invention is further particularly directed toward a rolling closure comprising a series of panels with adjacent panels pivotally joined together. Each panel comprises a front wall, a back wall and first and second side wall sections joining the front and back walls together. A hinge socket in the back wall of each panel, adjacent one of the side walls, is used to pivotally join the panel to an adjacent panel.

The invention is also particularly directed toward a method of constructing an insulated panel for a rolling closure. The method comprises extruding a first panel section having a front wall and outer side wall sections, and extruding a second panel section hving a back wall and inner side wall sections. A plurality of pairs of spacers of different thickness are also extruded. A pair of spacers of desired thickness are selected to give a panel of the desired thickness and are used to connect the sections together at their side wall sections to form a tubular panel. The tubular panel is then filled with an expandable foam insulating material.

BRIEF DESCRIPTION OF THE DRAWINGS

The invention will now be described in detail having reference to the accompanying drawings in which:

FIG. 1 is a cross-section view of one panel employed in a rolling closure:

FIG. 2 is a cross-section view of a spacer employed in the panel shown in FIG. 1;

FIG. 3 is a detailed cross-section view of one of the panel sections used in the panel shown in FIG. 1;

FIG. 4 is a detailed cross-section view of the other panel section used in the panel shown in FIG. 1;

FIG. 5 is a detailed cross-section view of a closure showing the connection between two panels, of the type shown in FIG. 1 used in the closure;

DESCRIPTION OF THE PREFERRED EMBODIMENTS

Figure 6:
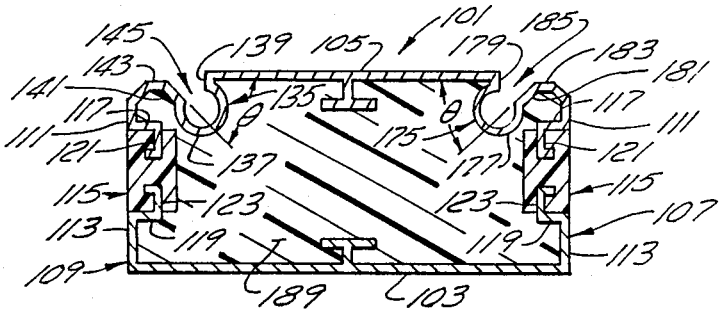
FIG. 6 is a cross-section view of another panel employed in a rolling closure.

The panel 1 used in the rolling closures, as shown in FIG. 1, has a generally rectangular cross-sectional shape with a front wall 3 and a parallel back wall 5. A first side wall 7 and a second side wall 9 join the front and back walls 3, 5 together at their sides.

Each of the first and second side walls 7, 9 comprise an inner and outer wall section 11, 13 joined by a spacer 15. The spacer 15 is extruded from a poor heat conducting material such as a thermoplastic and provides a thermal break between the front and back walls 3, 5 of the panel. The free ends of the wall sections 11, 13 of the side walls 7, 9 have arms 17, 19 carrying inwardly and outwardly directed L-shaped connectors 21, 23. Slots 25, 27 are provided in the sides 29, 31 of the spacer element 15 as shown in FIG. 2, to slidably receive the L-shaped connectors 21, 23 and to thus have the spacer element 15 join the side wall sections 11, 13 together.

A hinge socket 35 is formed in the back wall 5 near one of the side walls 9. The socket 35 extends across the back wall and is parallel to the side wall 9. The socket 35 is formed by a part circular wall 37 starting at a transverse edge 39 of the back wall 5 and extending over slightly more than 270°. A connecting wall 41 joins the circular wall 37 to a short section 43 of the back wall 5 which section 43 connects to the inner section 11 of the side wall 9. The connecting wall 41 extends at an angle $\theta$ away from the edge 39, and, together with edge 39, forms a narrow opening 45 into socket 35. This opening 45 is narrower in cross-section than the cross-section of the socket 35. The short back wall section 43 is parallel with the rest of the back wall 5 but is slightly depressed a distance substantially equal to the thickness of the back wall 5.

An extension 51 of the back wall 5 projects past the other side wall 7 as shown in FIG. 1. The extension 51 carries a part tubular hinge pintle 53 via an arm 55 extending outwardly and inwardly from the end of the extension 51. The pintle 53 also extends across the back wall 5, parallel to side wall 7. The pintle 53 is sized to rotatably fit snugly within a socket identical to socket 35. The pintle 53 is larger in cross-section than the cross-section of opening 45. Arm 55 extends outwardly and inwardly at an angle $\theta$ which is the same angle $\theta$ at which the connecting wall 41 extends. This angle $\theta$ preferably is 45°.

The panel 1 is manufactured by extruding a first panel section 61 as shown in FIG. 3, consisting of the front wall 3 and the outer sections 13 of the two side walls 7, 9; and by extruding a second panel section 63, as shown in FIG. 4, consisting of the back wall 5 and the inner sections 11 of the two side walls 7, 9. The second section 63 includes the socket 35 and the pintle 53. Both sections 61, 63 can include a T-shaped rib 65, 67 respectively formed on the central inner surface of the front and back walls 3, 5 to reinforce the sections. The first and second sections 61, 63 are extruded from a lightweight, metallic material such as aluminum. A series of spacers 15 can be provided of different thicknesses so that panels 11 of different thicknesses can be assembled. A pair of spacers 15, of the desired thickness, is used to connect the first and second panel sections 61, 63 together at their ends via the connectors 21, 23 on the sections 61, 63 and the slots 25, 27 on the spacers 15. The tubular panel 1 so formed can then be filled with a thermoplastic, expandable foam material 69 as shown in FIG. 1, to provide the insulation in the panel 1. The foam material 69 locks to ribs 65, 67 to help hold the panel 1 together.

A plurality of the panels 1 are assembled together, one after the other, to form a rolling closure 71. As shown in FIG. 5, the pintle 53*a* on a first panel 1*a*, is slidably mounted in the socket 35*b* of the next adjacent panel 1*b* to pivotally connect the panels 1*a*, 1*b* together. The arm 55 is located in the narrow opening 45 while extension 51 is adjacent wall section 43. The pivotal connection permits the panels to be rolled on a drum for storage. When the closure is unrolled, each panel carries the panels below it by the pintle of the adjacent bottom panel located in the socket of the said panel. The pintle and socket constructions, together with the narrow opening into each socket, allow the panels to be serially supported when the closure is unrolled. The adjacent side walls 7*a*, 9*b* of adjacent panels 1*a*, 1*b* are very close together and can even abut presenting an unrolled closure with a smooth outer surface 73 formed by in-line, closely adjacent front walls 3*a*, 3*b*. Even if the adjacent panels do not abut, any gap between them is closed by the extension 51*a* of the back wall 5*a* of the panel 1*a* extending over the gap. The recessed back wall section 43*b* on the adjacent panel 1*b*, permits the extension 51*a* to lie in the same plane as the back wall 5*b* on adjacent panel 1*b*. Thus a smooth, in-line, inner face 75 is also provided on the closure.

The insulation 69 is of generally uniform thickness throughout the panel, except at the socket location, thus providing a closure with more uniform insulation properties. Good insulation is provided at the sides of the panel since the sockets are located inwardly of the sides. The sockets do not extend deep into the panel and thus there is considerable insulation even at the socket locations. The spacers employed provide a suitable thermal break between the front and rear surfaces of the closure. The spacers also make it easy to assemble the panels and to construct panels of varying thickness.

In another embodiment of the invention, panels 101 can be employed which have a hinge socket in the back wall at each side of the panel and which require a separate hinge member to join adjacent panels together. Panel 101 is very similar in construction to panel 1, and features in panel 101, identical to features in panel 1, will be designated with the same reference characters, increased by one hundred. Panel 101 has a front wall 103, a parallel back wall 105, and side walls 107, 109 joining the front and back walls 103, 105 together at their ends as shown in FIG. 6.

Figure 7:
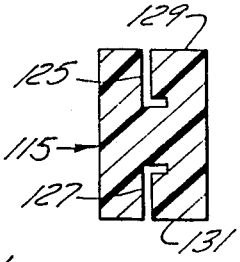
FIG. 7 is a cross-section view of a spacer used in the panel shown in FIG. 6.

Each side wall 107, 109 comprises an inner and outer section 111, 113 joined by a spacer 115. The free ends of the sections 111, 113 have arms 117, 119 respectively carrying L-shaped connectors 121, 123. Slots 125, 127 are provided in the sides 129, 131 of the spacer 115 as shown in FIG. 7 to slidably receive the L-shaped connectors 121, 123 and to thus have the spacers 115 join the side wall sections 111, 113 together.

A first hinge socket 135 is formed in the back wall 105 near one of the side walls 109. The socket 135 is formed by a part circular wall 137 starting at a transverse edge 139 of the back wall 105, and extending over slightly more than 270°. A connecting wall 141 joins the circular wall 137 to a short back wall section 143 which connects to the inner section 111 of the side wall 109. The connecting wall 141 extends at an angle $\theta$ away from the edge 139 and, with the edge, forms an opening 145 into socket 135. The back wall section 143 is recessed slightly, a distance equal to the thickness of the back wall 105, but is parallel with the back wall 105.

A second hinge socket 175 is formed in the back wall 105 near the other side wall 107. The second socket 175 is the same size and shape as the first socket 135 and comprises a part circular wall 177 starting at a transverse edge 179 of the back wall 105, and extending over slightly more than 270°. A connecting wall 181 joins the part circular wall 177 to a short back wall section 183 which connects to the inner section 111 of the side wall 109. The connector wall 181 extends at an angle $\theta$ away from edge 179, and with the edge, forms an opening 185 into the socket 175. The back wall section 183 is recessed slightly inwardly from back wall 105 but parallel to it. Back wall section 183 is aligned with the back wall section 143 adjacent the first hinge socket 135.

Figure 9:
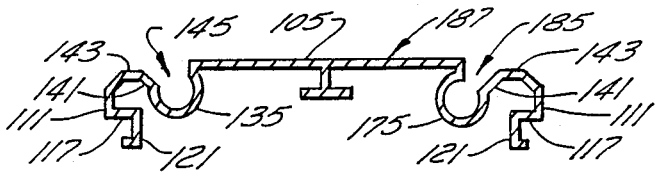
FIG. 9 is a detailed cross-section view of the other panel section used in the panel shown in FIG. 6.
Figure 8:
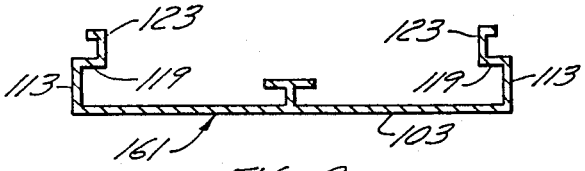
FIG. 8 is a detailed cross-section view of one panel section used in the panel shown in FIG. 6.

Panel 101 is manufactured by extruding a first panel section 161, as shown in FIG. 8, consisting of the front wall 103 and the outer sections 113 of the two side walls 107, 109. A second panel section 187, as shown in FIG. 9, is also extruded consisting of back wall 105 and the inner sections 111 of the side walls 107, 109. Both sections 161, 187 can include ribs (not shown) similar to ribs 65, 67. The first and second hinge sockets 135, 175 are formed in the back wall 105 of the second extruded section 187. The first and second sections 161, 187 are connected together at their ends by a pair of spacers 115. The thickness of the spacers 115 employed may vary depending on the thickness of the panel desired. The tubular member, formed by connecting sections 161, 187 together with spacers 115, is filled with a thermoplastic, expandable foam material 189 as shown in FIG. 6, to provide an insulated panel 101.

Figure 10:
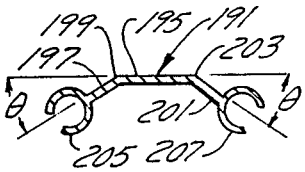
FIG. 10 is a cross-section view of a hinge member employed with the panel of FIG. 6.
Figure 11:
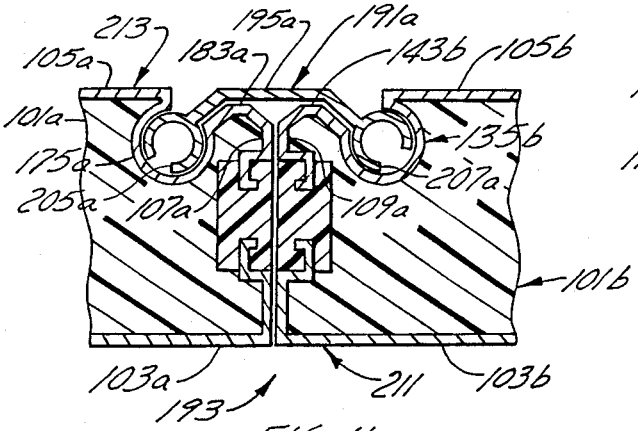
FIG. 11 is a detailed cross-section view of a closure showing the connection between two panels, of the type shown in FIG. 6, using the hinge member shown in FIG. 10.

A plurality of the panels 101 are joined together in series by separate hinge members 191, as shown in FIG. 10, to form a rolling closure 193, as shown in FIG. 11. Each hinge member 191 includes a main support wall 195, a first connecting wall 197 extending at an angle $\theta$ outwardly from one side 199 of support wall 195 and a second connecting wall 201 extending at an angle $\theta$ outwardly from the other side 203 of support wall 195. A part-tubular, first hinge pintle 205 is provided at the end of the first connecting wall 197 and a part-tubular, second hinge pintle 207 is provided at the end of the second connecting wall 201. The hinge members 191 are extruded and cut to length from a lightweight, metallic material such as aluminum.

As shown in FIG. 11, a first hinge member **191*a* pivotally joins first and second closure panels 101*a*, 101*b* together with the first pintle 205*a* slidably mounted in the second socket 175*a* of first panel 101*a* and with the second pintle 207*a* slidably mounted in the first socket 135*b* on the second panel 101*b*. When the closure is unrolled, the side wall 107*a* of the first panel 101*a*, lies closely adjacent to, or abuts, the side wall 109*b* on the second panel 101*b*. The front walls 103*a*, 103*b* of panels 101*a*, 101*b* are aligned to form a smooth front face 211 on the closure. The support wall 195*a* of the hinge 191*b* overlies the recessed wall sections 183*a*, 143*b* in the back walls 105*a*, 105*b* of the panels 101*a*, 101*b* and is substantially aligned with the back walls 105*a*, 105*b* to form a smooth inner face 213 on the closure. Any gap between the adjacent side walls 107*a*, 109*b* of adjacent panels 101*a*, 101*b* is covered by the support wall 195*a* of the hinge 191*a***.

The embodiment employing separate hinges 191 to join the panels 101 provides a rolling closure which winds more closely on a drum during storage thus requiring less space. This is because the double hinge sockets 135, 175 on the panels 101 reduce the distance between adjacent pivot locations as compared to the distance between adjacent pivot locations on the panels 1 having a single hinge socket 35.

I claim:

1. A panel for a rolling closure which closure comprises a plurality of panels hingedly connected together so that the closure can be wound on a drum for storage; each panel having: a front wall; a back wall generally parallel to the front wall; two side walls joining the front and back walls together to form a tubular structure having a generally rectangular cross-section; a hinge socket formed within the tubular structure and located adjacent the back wall and one of the side walls, the hinge socket extending across the structure parallel to the back wall and one side wall, the hinge socket defined by a wall that is part-circular when viewed in cross-section and that extends over an arc that is substantially greater than 180°; wall means connecting the hinge socket to the back wall, said connecting wall means defining an opening extending from the back wall into the socket, said opening being narrower in cross-section than the cross-section of the socket; an extension of the back wall projecting past the other side wall, an arm projecting from the extension, the arm carrying a hinge pintle, the hinge pintle located by the arm and the extension to snugly, rotatably fit into the hinge socket of an adjacent panel to hingedly connect the panels together so that they can be wound on a drum, the arm located in the opening when the pintle is in the socket; the pintle being larger in cross-section than the cross-section of the opening so that the pintle of any one panel can carry the panels below it when the rolling closure is unwound from the drum.

2. A panel for a rolling closure which closure comprises a plurality of panels hingedly connected together so that the closure can be wound on a drum for storage, each panel comprising: a first integral panel section having a front wall and two side walls at the sides of the front wall; a second integral panel section having a back wall and two side walls at the sides of the back wall, a pair of connecting means with one connecting means connecting one side wall of the first panel section to one side wall of the second panel section and the other connecting means connecting the other side wall of the first panel section to the other side wall of the second panel section to form a tubular structure having a generally rectangular cross-section; a hinge socket formed within the tubular structure, and located adjacent the back wall and one side wall of the second panel section, the hinge socket extending across the structure parallel to the back wall and one side wall, the hinge socket defined by a wall that is part-circular when viewed in cross-section and that extends over an arc that is substantially greater than 180°; wall means connecting the hinge socket to the back wall, said connecting wall means defining an opening extending from the back wall into the socket, said opening being narrower in cross-section than the cross-section of the socket; an extension of the back wall projecting past the other side wall of the second panel section, an arm projecting from the extension, the arm carrying a hinge pintle, the hinge pintle located by the arm and the extension to snugly, rotatably fit into the hinge socket of an adjacent panel to hingedly connect the panels together so that they can be wound on a drum, the arm located in the opening when the pintle is in the socket; the pintle being larger in cross-section than the cross-section of the opening so that the pintle of any one panel can carry the panels below it when the rolling closure is unwound from the drum.

3. A panel as claimed in claim 7 wherein each connecting means, and the two side walls that said connecting means connects, forms a planar side surface on the panel.

4. A panel as claimed in claim 3 wherein the first and second panel sections are made from extruded, metallic material and the connecting means are made from non-heat conducting material.

5. A panel as claimed in claim 3 wherein the back wall between the hinge socket and the one side wall in the second panel section is slightly recessed a distance generally equal to the thickness of the extension of the back wall.

* * * * *